United States Patent [19]

Guebert et al.

[11] 4,237,958

[45] Dec. 9, 1980

[54] DRAPERY CONNECTOR ASSEMBLY

[76] Inventors: Gerald E. Guebert, Farmers Branch; Raymond R. Belknap, Austin, both of Tex.

[21] Appl. No.: 731,347

[22] Filed: Oct. 12, 1976

[51] Int. Cl.[3] ..... A47H 1/00

[52] U.S. Cl. ..... 160/330

[58] Field of Search ..... 160/330, 348; 248/214; 24/221 R

[56] References Cited

U.S. PATENT DOCUMENTS

| | | | |
|---|---|---|---|
| 710,477 | 10/1902 | Littell | 160/330 |
| 2,665,869 | 1/1954 | Samuels | 248/214 |
| 3,193,062 | 7/1965 | Pendleton | 403/283 |
| 3,437,127 | 4/1969 | Lukashok | 160/330 |
| 3,905,414 | 9/1975 | Guebert et al. | 160/330 |

FOREIGN PATENT DOCUMENTS 561920 6/1944 United Kingdom .

*Primary Examiner*—Peter M. Caun

*Attorney, Agent, or Firm*—Hubbard, Thurman, Turner, Tucker & Glaser

[57] ABSTRACT

An improved drapery connector assembly for draping a table, stage, or the like, is disclosed. The assembly is utilized to drape a table, stage, or the like, having a peripheral edge with a downwardly extending flange member around the peripheral edge, includes a plurality of clips that are resiliently and slideably clamped along the peripheral edge. The clips generally comprise a face section, having an inner surface and an outer surface with a first fastener disposed on the outer surface of the face section. An upper leg section transversely intersects the face section along the upper portion thereof and a lower leg section is affixed to the lower portion of the face section with at least a portion of the lower leg section extending upwardly along the inner surface of the face section whereby at least a portion of the lower leg section is adjacent the inner surface of the face section at a point intermediate the upper and lower portions of the face section. The clips are adapted to engage the inner surface of the upper leg and the inner surface of the face section with the top and front portions of the peripheral edge of the table, stage or the like, as the upstanding portion of the lower leg assembly simultaneously abutts the back side of the downwardly extending flange. The fastener, affixed to the outer edge of the face section is adapted to receive and restrain, in mating engagement, a fastener attached to a suitable drapery whereby the drapery will be suspended from the plurality of clips.

9 Claims, 6 Drawing Figures

DRAPERY CONNECTOR ASSEMBLY

BACKGROUND OF THE INVENTION

This invention relates to an improved system for draping a table, stage or the like, of the type having a peripheral edge with a downwardly extending flange around said peripheral edge. In another aspect, this invention relates to an improved clip assembly for draping a table, stage or the like, having a peripheral edge with a downwardly extending flange member around the peripheral edge. In yet another aspect, this invention relates to an improved drapery connector assembly system for removably attaching drapes and similar trimmings to tables, stages, and the like, of the type having a peripheral edge with a downwardly extending flange member around said peripheral edge.

Temporary stages, platforms and tables are widely used in hotels, restaurants, assembly halls, stadiums and the like. Normally, such tables, stages or elevated platforms are heavy structural components that must be decorated to make them more attractive for festive uses. In decorating or trimming such heavy structural elements, the use of drapery materials has been widely used since a properly applied drapery material makes such heavy structural components particularly pleasing to the eye. When drapery materials are utilized to decorate or trim such heavy structural elements, a variety of methods for attaching the drapery or bunting materials to the heavy structural elements have been used.

While various types of techniques and apparatus have been used to secure or attach drapery or bunting materials to heavy structural elements having a peripheral edge with a downwardly extending flange member around the edge, such systems have all met with a certain amount of failure. In the past, it has been generally accepted that drapery or bunting materials should be attached to tables, stages, and other platforms, having a peripheral edge that includes a downwardly extending flange member, by means of nailing, stapling, glueing or taping the bunting or drapery material to the flange. While in some cases this may be a very good method for draping or trimming the structural component, it will be appreciated that such a method for attaching the bunting or drapery material is time consuming and somewhat permanent. When drapery material is affixed to a structural element such as the downwardly extending flange around the edge of a table, stage or platform by means of nailing, stapling, gluing or taping, it is very difficult to thereafter remove the drapery or bunting material without damaging it. It, of course, will also be realized that often, the downwardly extending flange element is a metallic element and it is virtually impossible to either staple or nail a drapery or bunting element to the peripheral edge of such a table, stage or raised platform.

There, of course, have been various types of elements and techniques utilized in the past in an attempt to decorate or trim such structural elements with bunting or drapery. Such apparatus and techniques have utilized very crude and ineffective clips or other structural elements that have been placed over the peripheral edge of a table, stage, or other raised platform. Permanently mounted clips have also been affixed to such structures for hanging drape materials therefrom. Generally speaking, such prior art clips and the like have not been widely utilized because it has not been feasible to place such prior art apparatus over downwardly extending flanges around the periphery of a table, stage, or raised platform and protect them from damage when the table, stage or platform is disassembled and stored.

Even in those situations where a drapery material can be effectively attached to the periphery of a stage, table, or other raised platform by time consuming conventional methods, a considerable problem has developed when it is necessary to remove the drapery material for replacement and/or cleaning. In such situations where the drapery material is nailed, stapled, taped or glued to the periphery of a table, it is extremely difficult to remove the material for cleaning or changing without tearing or otherwise damaging the drapery material.

It is, therefore, apparent that there is a need for an improved drapery connector assembly for attaching drapery materials to the periphery of a stage, table or other raised platform. It is also apparent that there is a need for a simplified removable clip assembly that can be utilized for affixing a drapery material to a table, stage, or raised platform having a downwardly extending flange around the periphery of such component.

SUMMARY OF THE INVENTION

Accordingly, it is an object of this invention to provide an improved assembly for draping a table, stage, or the like, of the type having a peripheral edge with a downwardly extending flange member around said peripheral edge. It is another object of this invention to provide an improved clip assembly for draping a table, stage or the like, having a peripheral edge with a downwardly extending flange member around such peripheral edge. It is yet another object of this invention to provide an improved system for the rapid application of a drapery material to a table, stage or the like, having a downwardly extending flange around its periphery with the capability of rapidly removing the drapery material without damage thereto.

Other aspects, objects and advantages of this invention will be apparent to those skilled in the art from the following description and appended claims.

In the instant invention, tables, stages, raised platforms and the like, of the type having a peripheral edge with a downwardly extending flange member around the peripheral edge can be easily and conveniently draped or trimmed by affixing a drapery material to a plurality of clip assemblies that are resiliently and slideably clipped onto and along said peripheral edge. Each of the clips comprises a face section having an inner surface and an outer surface with an upper leg section transversely intersecting the face section along the upper portion thereof. A lower leg section is affixed to the lower portion of the face section and extends upwardly along the inner surface of the face section whereby at least a portion of the lower leg is adjacent the inner surface of the face section at a point that is intermediate the upper and lower portions of the face section. The clips are adapted to engage the top and front surfaces of the peripheral edge by contacting the inner surface of the upper leg section and the inner surface of the face section therewith, while the portion of the lower leg section that is adjacent the inner surface of the face section simultaneously abutts the back portion of the downwardly extending flanges. The lower leg section is springingly affixed to the face section to thereby press against and contact the back portion of the flange section and urge the lower leg section toward the inner surface of the face section to thereby clampingly engage the downwardly extending flange of the peripheral edge of the structure to be decorated. A suitable fastener means is affixed to the outer surface of the face section and the drapery means can be affixed to such fastener means. By using a plurality of such clip assemblies, the structure can be uniformly draped or trimmed with drapery means that operably engages the fastener means on the outer surface of the plurality of face sections.

DESCRIPTION OF PREFERRED EMBODIMENTS

Figure 1:
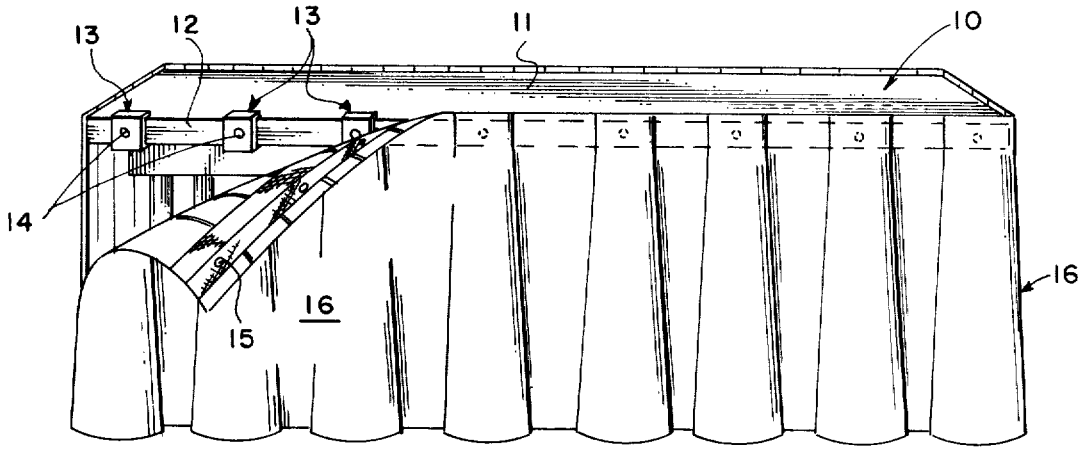
FIG. 1 illustrates the use of the improved drapery connector assembly of this invention for attaching a drapery to a table.

The apparatus of this invention can best be described by referring to the drawings.

As illustrated in FIG. 1, table 10 has table top 11 and downwardly extending flange 12 affixed to and running around the periphery of table top 11. A plurality of clip assemblies 13 are affixed to the peripheral edge of table 10, as hereinafter described. On the outer surface of the face section 17 of clip assembly 13 fastener means 14 is operably affixed. Fastener means 14 matingly engages fastener means 15 affixed to drapery means 16. As will be more fully described hereinafter, fastener means 15, attached to drapery means 16, matingly engages and is secured by corresponding fastener means 14 of the clip assembly 13 to thereby suspend and hold the drapery means in place.

By the proper positioning of clip assemblies 13 along the peripheral edge of table 10, drapery means 16 can be uniformly suspended from such clip assemblies to thereby drape or decorate the table assembly. Likewise, by utilizing mating fastener means 15 on drape assembly 16 and on the clip assemblies 13, drapery means 16 can be rapidly removed from the clip assemblies without damage through the drapery means. Clip assemblies 13 are removable from the peripheral edge of the table or the like, and are slideably clamped to such edge whereby then can be moved along the edge of such table or the like.

Figure 2:
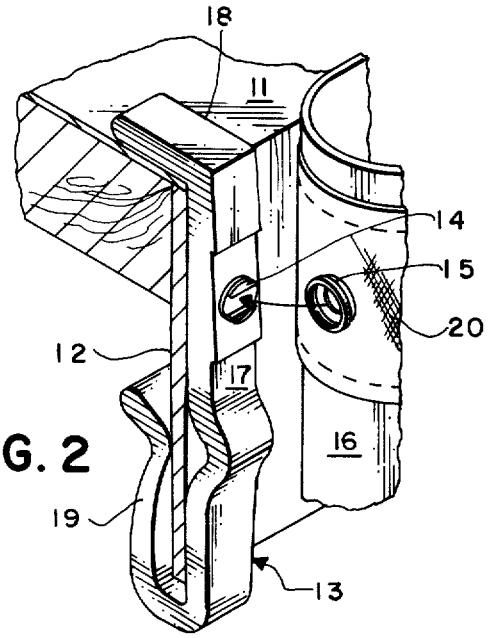
FIG. 2 is a perspective view of one of the preferred improved drapery connector assemblies of this invention, affixed to a table having a downwardly extending flange around the periphery thereof, with the general orientation of a drapery means as it is about to be affixed to the clip assembly.

FIG. 2 is a perspective view of one of the preferred clip assemblies of this invention, installed along the peripheral edge of a table having downwardly extending flange 12. For purposes of illustrating the invention, a portion of table top 11 has been cut away to expose downwardly extending flange 12 and the cooperation of the various portions of the clip assembly 13 to engage such downwardly extending flange 12 of the table.

As illustrated in FIG. 2, table top 11 has downwardly extending flange 12 affixed to the peripheral edge thereof. Downwardly extending flange 12 extends downwardly to a point where it terminates at a point substantially below the bottom surface of table top 11, thereby forming a lip. Clip assembly 13 is adapted to simultaneously engage table top 11, the face of downwardly extending flange 12 and the back side of downwardly extending flange 12 to thereby hold clip assembly 13 in place by means of a clamping action.

Clip assembly 13 includes face section 17 that is sized such that it is at least as long as downwardly extending flange 12. Affixed to the upper portion of face section 17 is upper leg section 18. Upper leg section 18 transversely intersects and is affixed to the upper portion of face section 17. Generally, upper leg section 18 transversely intersects face section 17 at a right angle whereby the inner surface of upper leg section 18 and the inner surface of face section 17 will fit over and simultaneously engage the square corner of the table top 11 and the outer face of downwardly extending flange 12. Preferably, upper leg section 18 is substantially rigidly affixed to the upper portion of face section 17 whereby there is little or no deformation or bending of the upper leg section and the face section with respect to each other when the clip is installed and the drapery is hung from the clip assembly. In some instances, it may be desirable to incorporate a reinforcing rib along the outer surfaces of upper leg section 18 and face section 17 to strengthen the joint and lessen undue deformation.

Lower leg section 19 is affixed to the lower portion of face section 17 in such a manner that lower leg section 19 extends upwardly along the back surface of face section 17 for a substantial distance. At least a portion of lower leg section 19 is substantially adjacent to the back surface of face section 17 whereby lower leg section 19 will engage and contact the back side of downwardly extending flange 12 while the inner surface of face section 17 and the inner surface of upper leg section 18 simultaneously abut the outward face of downwardly extending flange 12 and the upper surface of table top 11, as more clearly seen in FIG. 2. In a preferred embodiment, the upper portion of lower leg section 19 bears against the back surface of downwardly extending flange 12 in a resilient or clamping type action to securely contact at least a portion of lower leg section 19 with the back side of downwardly extending flange 12 while the inner surface of face section 17 is drawn tightly against the outer surface of downwardly extending flange 12.

A spring-like action is achieved by a resilient fixing or attachment of lower leg section 19 to the lower portion of face section 17 to thereby cause lower leg section 19 to clampingly engage downwardly extending flange 12.

Disposed along the outer surface of face section 17 is fastener means 14 that will receive and support a suitable drapery means. As illustrated in FIG. 2, fastener means 14 can be a male connector that will frictionally engage female connector means 15, which can be affixed to drapery means 16. It will be appreciated that a plurality of clip assemblies 13 should be placed along the peripheral edge of table 10 at various points whereby the plurality of clip assemblies can engage a plurality of fastener means 15, which are affixed to drapery means 16. Fastener means 15 can be conveniently affixed to drapery means 16 by means of a heavy tape 20 which can be sewn or otherwise attached to the upper portion of drapery means 16 to receive and support fastener means 15.

It will be appreciated that, while FIG. 2 illustrates male and female fasteners 14 and 15 to affix the drapery means 16 to clip assemblies 13, other fastener means and systems can also be utilized for affixing or attaching drapery means 16 to clip assemblies 13. For example, hooks, other types of snaps and "Velcor" (a trademark) fastener materials can be utilized.

Figure 6:
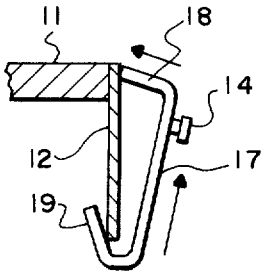
FIG. 6 is a side sectional view of a table assembly with a clip assembly of this invention as it is being applied to the table.

Clip assembly 13 can be conveniently attached to the peripheral edge of the table, as illustrated in FIG. 2, by inserting the lower edge of downwardly extending flange 12 in the groove or throat formed by the top portion of lower leg 19 and the inner surface of face section 17 as illustrated in FIG. 6. By an upward-lifting motion of clip assembly 13, as shown by the vertical arrow, lower leg section 19 will be bent outwardly from the inner surface of face section 17 and by continued upward force on clip assembly 13, upper leg section 18 will slide upwardly along the outer peripheral edge of the table assembly to a point where it clears the top of the table assembly and will snap into place, as illustrated in FIG. 2 whereby the inner surface of upper leg section 18 contacts the top of the table assembly while the inner surface of face section 17 contacts the outer edge of downwardly extending flange 12 as lower leg section 19 simultaneously abuts and clampingly engages the back surface of downwardly extending flange 12. In order for such clamping engagement to be realized and in order for the clip assembly 13 to be applied in a manner as described above, it will be appreciated that lower leg section 19 must be springingly affixed to face section 17 whereby it can be outwardly deformed or stretched away from a point adjacent the inner surface of face section 17 and then snap back to clamp against the downwardly extending flange.

Within the broad teachings of the foregoing disclosure, several different types of preferred clip assemblies 13 can be utilized in the instant invention. Three of such preferred clip assemblies 13 are illustrated in detail in FIGS. 3, 4 and 5.

Figure 3:
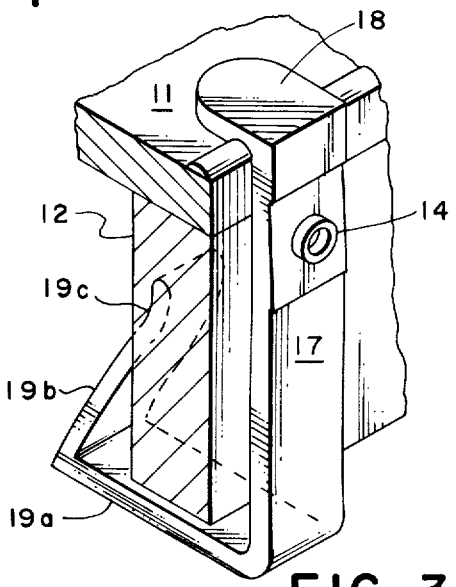
FIG. 3 is a perspective view of another preferred clip assembly of this invention affixed to a table, stage, or the like, having a downwardly extending flange around the periphery thereof.

In FIG. 3, one preferred clip assembly includes face section 17 with suitable fastener means 14 operably affixed to the outer surface of face section 17. Operably affixed to the upper portion of face section 17 is upper leg section 18 which is adapted to extend out over table top 11. If desired, a suitable groove or other channel can be transversely disposed across the base of upper leg 18 to receive any upstanding bead or lateral raised section around the periphery of table top 11. In the preferred embodiment of FIG. 3, face section 17 is sufficiently long to allow downwardly extending flange 12 of the table, stage, or other platform to rest completely within the inner surface of face section 17. Lower leg section 19 is springingly affixed to the lower portion of face section 17 to allow it to press against and clamp against the back side or surface of downwardly extending flange 12 of table 10. As illustrated in FIG. 3, that preferred embodiment of the invention is sized to receive a relatively thick downwardly extending flange 12 of a table, stage, or the like. Lower leg section 19 in FIG. 3 includes lower leg section **19*a* that extends substantially at right angles to face section 17. Upwardly extending lower leg section 19*b* extends upwardly along the back surface of face section 17 to a point where the upper end of lower leg section 19*b* terminates at a point 19*c* that is adjacent the back side of face section 17. In the preferred embodiments of this invention, the distance between end portion 19*c* and the inner surface of face section 17 will be less than the thickness of downwardly extending flange 12 of the table, stage, or the like, on which the described clip assembly is being applied. By sizing the apparatus such that the distance between point 19*c* and the adjacent inner surface of face section 17 is less than the thickness of downwardly extending flange 12, there will be a clamping action that will urge, or draw, the inner surface of face section 17 toward and into contact with the outer face of downwardly extending flange 12 while lower leg section 19 will simultaneously abutt and clampingly engage the back side of downwardly extending flange 12**.

Figure 4:
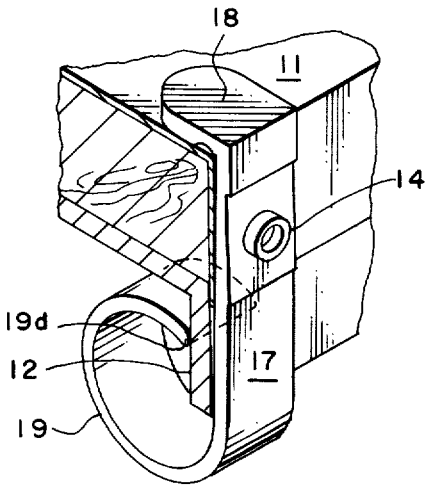
FIG. 4 is a perspective view of yet another preferred clip assembly of this invention affixed to a table, stage, platform, or the like, having a downwardly extending flange.

In FIG. 4, still another embodiment of the invention is illustrated wherein face section 17 also has fastener means 14 affixed to the outer face thereof. Upper leg section 18 is operably affixed to the upper portion of face section 17. In FIG. 4, lower leg section 19 is, in effect, a tangential extension of face section 17 in a cirvulinear direction such that the outer end of **19*d* of lower leg section 19 terminates at a point adjacent to the back side of face section 17. As mentioned above, the distance between point 19*d* and the inner surface of face section 17 will be less than the width of downwardly extending flange 12 of the table, platform, or the like, being draped with the illustrated clip assembly. Thus, when the clip assembly of FIG. 4 is applied to a table, stage, or other platform having an outwardly extending flange 12, the springing action of lower leg section 19 as end portion 19*d* is forced away from the inner surface of face section 17 will cause a clamping engagement of the clip assembly to thereby urge the inner surface of face section 17 into contact with the face of downwardly extending flange 12 while lower leg section 19 simultaneously abuts against the back side of flange section 12**.

Figure 5:
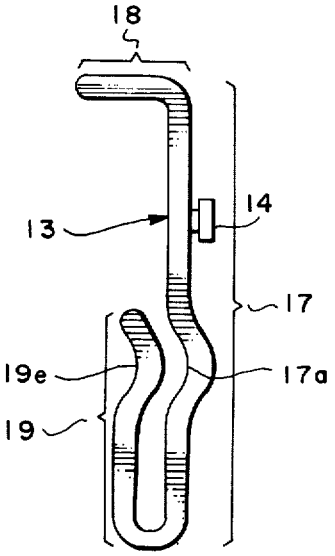
FIG. 5 is an end elevational view of the clip assembly illustrated in FIG. 2.

Yet another preferred clip assembly of this invention is illustrated in FIG. 5. As illustrated in FIG. 5, face section 17 has fastener means 14 affixed to the outer surface thereof. Upper leg section 18 is preferably affixed to the upper portion of face section 17 at substantially right angles whereby the clip assembly will fit over the right angle edge formed by table top 11 and the outer surface of downwardly extending flange 12. In the clip assembly illustrated in FIG. 5, lower leg section 19 is affixed to the lower portion of face section 17 by means of a tangential extension of the lower portion of face section 17 in a fairly small radius of curvature whereby lower leg section 19 extends in a substantially 180° turn to extend upwardly along the inner surface of face section 17 to point **19*e* that is adjacent the upper and lower portions of face section 17 and at a point adjacent the inner surface of face section 17. As illustrated in FIG. 5, face section 17 has a transversely disposed loop, or indention 17*a*, along the midsection thereof, whereby lower leg section 19*a* also transversely loops toward transverse loop 17*a* along the inner surface of face section 17. The purpose of such an arrangement is to allow at least a portion of lower leg section 19 to extend to a point substantially near the plane of the inner surface of face section 17. When lower leg section 19 of FIG. 5 extends substantially near the plane of the inner surface of face section 17, additional spring force can be achieved as lower leg section 19 is bent outwardly to ride up over the inner surface of downwardly extending flange 12. Such an arrangement creates additional clamping force to more securely hold clip assembly 13** to the periphery of the table, stage, or the like, to be draped and assists in the rapid installation of the clip assembly on the table or stage to be draped.

It will be appreciated that clip assemblies 13 are in frictional engagement with the periphery of the table, stage, or the like, to be draped, but they can be moved along the periphery of the table, stage, or the like, by applying sufficient horizontal force to overcome the frictional engagement of the various components as described above. Such a capability allows a plurality of clips to be affixed to the peripheral edge of a table, stage, or the like, and thereafter be properly positioned by simply sliding the clip assemblies along the peripheral edge of the table, stage, or the like. This allows a very rapid method for affixing a drapery means to such structures. It is not particularly necessary to accurately position each one of the clamps in precisely the location necessary to receive the mating fastener of the drapery assembly to be applied to the structure. Once the clip assemblies are clipped into proper position with respect to the engagement of the downwardly extending flange, they can thereafter be slid back and forth in a horizontal direction along the periphery of the table or stage assembly and the drapery means can be conveniently affixed to the clip assemblies once they are in proper position.

Clip assemblies 13 can be fabricated from any suitable material. It has, however, been found that it is particularly desirable to form clip assemblies 13 from a thermoplastic material that can be injection-molded, such as a polycarbonate material, polystyrene material, ABS material, and the like. In all instances, however, it is particularly desirable to utilize a material for fabricating clip assemblies 13 from that is resilient and can be conveniently molded to produce a clip assembly having the desired flexibility properties to allow the clip assembly to springingly and clampingly engage the downwardly extending flange member 12 of the periphery of the components to be draped.

With the drapery connector assembly as thus described, several distinct advantages are obtained. For example, there is no need to tack or staple the drapery means to the table, thus preventing damage thereto. Additionally, the drapery material can be conveniently and rapidly applied and removed, and interchanged with a minimum to effort and time. Also, it will be appreciated that there is no necessity for altering or modifying the table top or to provide means for permanently securing a drapery means thereto. Furthermore, by marketing a drape connector assembly, including clip assemblies 13 and a drape with fasteners 15 affixed thereto, a purchaser or user of the assembly may prepare custom drapes in advance and store them for future use.

It will be appreciated that the term, "drapery means", as used herein, includes any type of drapery, bunting, or other material that can be suspended from the connector means that are affixed to clip assemblies 13.

It should be appreciated that various modifications and changes of the disclosed embodiments, as well as additional embodiments, may be made by those skilled in the art after reviewing the foregoing description without departing from the spirit and scope of this invention.

What is claimed is:

1. A system for draping a table, stage, or the like, of the type having a peripheral edge with a downwardly extending flange member around said peripheral edge which comprises:

(a) a plurality of clips resiliently and slideably clamped onto and along said peripheral edge, each of said clips comprising a face section, having an inner surface and an outer surface with a first fastener means disposed at the outer surface of said face section, an upper leg section transversely intersecting said face section along the upper portion thereof and a lower leg section springingly affixed to the lower portion of said face section and extending upwardly along the inner surface of said face section whereby at least a portion of said lower leg is adjacent the inner surface of said face portion at a point intermediate the upper and lower portions of said face section;

(b) each of said clips clamping said peripheral edge in a manner whereby the inner surface of said upper leg portion and the inner surface of said face portion are against the top and front surfaces of said peripheral edge, respectively, and said portion of said lower leg adjacent to the inner surface of said face section simultaneously abuts the back portion of said downwardly extending flange to thereby urge said inner surface of said face portion into contact with the front portion of said downwardly extending flange section, and to thereby maintain said inner surface of said upper leg portion in contact with said top surface of said peripheral edge when a load is exerted downwardly along said outer surface of said face section; and (c) drapery means having a plurality of second fastener means for detachable coupling with respective ones of said first fastener means of said clips.

2. The system of claim 1 wherein said lower leg section is a tangential extension of said face section in a curvilinear direction.

3. The system of claim 1 wherein said second fastener means comprises a plurality of fastener means disposed along the upper edge of said drapery means.

4. The system of claim 3 wherein said first fastener means is a male fastener and said second fastener means is a female fastener means adapted to matingly engage said male fastener means in locking relationship.

5. The system of claim 1 wherein said upper leg section transversely intersects said face section at substantially right angles.

6. A clip assembly for draping a table, stage, or the like, of the type having a peripheral edge with a downwardly extending flange member around said peripheral edge which comprises:

(a) a face section having an inner surface and an outer surface;

(b) an upper leg section transversely intersecting said face section along the upper portion thereof;

(c) a lower leg section springingly affixed to the lower portion of said face section and extending upwardly along the inner surface of said face section with at least a portion of said lower leg being adjacent the inner surface of said face section at a point intermediate the upper and lower portions of said face section, and lower leg section being adapted to abut the back portion of said downwardly extending flange to simultaneously urge the inner surface of said face section into contact with the front surface of said downwardly extending flange while the inner surface of said upper leg section is in contact with the top surface of said peripheral edge when a load is exerted downwardly along said outer surface of said face section; and (d) a fastener means disposed on the outer surface of said face section for attaching a drapery means thereto.

7. The assembly of claim 6 wherein said lower leg section is a tangential extension of said face section in a tangential direction.

8. The assembly of claim 6 wherein said fastener means is a male fastener means.

9. The assembly of claim 6 wherein said upper leg section transversely intersects said face section at substantially right angles.

* * * * *